United States Patent [19]

Lenz

[11] 3,965,839

[45] June 29, 1976

[54] TROLLING BRAKE

[76] Inventor: George L. Lenz, Rte. No. 2, Cheboygan, Mich. 49721

[22] Filed: May 19, 1975

[21] Appl. No.: 578,627

[52] U.S. Cl. ..... 114/145 A; 415/8

[51] Int. Cl.[2] ..... B63H 25/44

[58] Field of Search ..... 114/145 A, 145 R, 66.5 P; 415/8

[56] References Cited

UNITED STATES PATENTS

| | | | |
|---|---|---|---|
| 655,140 | 7/1900 | Wendler | 114/209 |
| 2,050,336 | 8/1936 | Karasinski | 114/145 A |
| 2,751,875 | 6/1956 | Henry | 114/145 A |
| 2,787,974 | 4/1957 | Johnson | 114/145 A |
| 2,864,330 | 12/1958 | Cochran | 114/66.5 P |
| 3,565,030 | 2/1971 | Curtis | 114/66.5 P |
| 3,603,277 | 9/1971 | Manary | 114/145 A |

*Primary Examiner*—Stephen G. Kunin
*Assistant Examiner*—Stuart M. Goldstein
*Attorney, Agent, or Firm*—McGarry & Waters

[57] ABSTRACT

A trolling brake for a motor powered boat to enable the boat to move at varying slow speeds while the motor is running at idle without stalling the motor. The trolling brake is formed of a semicircular shield having a pair of forward ends pivotably mounted on the transom of the boat at or near the waterline and an adjustable support pivotably mounted at a rear portion of the shield and to the transom of the boat for adjusting the position of the shield in the water. The bottom edge of the shield slopes downwardly and rearwardly from the ends to a rear central portion and the shield has a pair of holes equidistant from the centerline of shield rear central portion to permit the passage of a controlled amount of water through the shield to facilitate steering of the boat with the shield in operative position. The center of curvature of the shield is substantially at the pivot point of the outdrive portion of an inboard-outboard motor and at the center of the craft when the boat has an inboard motor or motors. A supporting bracket is provided for storing the shield in an upright position on the transom of the boat when the brake is not in use.

13 Claims, 4 Drawing Figures

TROLLING BRAKE

BACKGROUND OF THE INVENTION

1. Field of the Invention

This invention relates to trolling brakes for boats. In one of its aspects, the invention relates to a trolling brake mounted to the back of the boat to control the speed of the boat when the boat motor is running at idle speed.

2. State of the Prior Art

In trolling for fish, it is necessary to run the boat at relatively slow speed so that the lures are moving at a relatively slow speed through the water. It is very difficult to adjust the speed of the boat to a slow speed because the motor will stall if the speed is too slow. Frequently, the idle speed of the boat is too fast for trolling. It has thus been recognized that a brake is desirable in order to attain desirable trolling speed.

Brakes for stopping vessels are known. In the U.S. Pat. No. to Wendler, 655,140, there is disclosed a drag brake for stopping a large vessel wherein a scooped drag plate is supported on a pair of links which are pivotably mounted to the side of the stern of the vessel. The drag plate is raised and lowered by a windlass which winds a rope or cable secured to a drag plate. Although this drag plate may have been useful in stopping larger vessels, it would not be suitable for controlling speeds in a fishing craft. The shape of the brake is designed for maximizing braking power, not for providing a controlled flow of water at slow speeds. Moreover, the drag of the Wendler brake would not be uniform during the turning of the marine vessel, since the brake is structured only to impart a maximum braking force on forward movement and not turning movement. Also, the shape of the brake could encumber steering of the vessel. Further, the structure would likely result in tangling of trolling lines with the propeller system. Finally, the brake is stored on the aft deck of the vessel, and such an arrangement would be completely unsatisfactory in a trolling operation where people sit on the aft deck of the vessel.

Various systems have been devised to control the trolling speed of the boat. A common method is to drag a sea anchor behind the boat. This system is crude and quite unsatisfactory. The sea anchor is not easily controllable and can result in lurching of the boat.

A trolling plate has also been used on the back of an outboard motor support shaft. Such trolling plates are disclosed in U.S. Pat. No. 2,155,112 to Anderson and U.S. Pat. No. 2,548,121 to Reid. These types of trolling plates create undesirable stresses on the motor housing and the motor mounts and occasionally result in breakage of the trolling plate mounting bracket. In addition, these plates produce undesirable torques which adversely affect the steering capabilities of the boat. Further, the plates occasionally result in the tangling of downrigger wires in the propeller wash and are not adaptable for inboard motors.

SUMMARY OF THE INVENTION

According to the invention, a trolling brake is provided to mount on the transom of a boat to enable the boat to move at varying slow speeds while the motor is running at idle without stalling of the motor. The trolling brake comprises an arcuately curved, preferably semicylindrical, shield having a pair of forward ends joined by a rear central portion. Means pivotably mount the shield at the front end to the transom of the boat at or near the waterline on the boat during normal operation thereof. Means secured to a rear portion of the shield adjustably support the shield at a rear portion thereof. Means are provided for mounting the adjustable support means to the upper portion of the transom of the boat.

Desirably, the shield has a top edge and a bottom edge with the bottom edge sloping downwardly and rearwardly from the sides to a rear central portion. The shield further has means at a rear central portion to permit the passage of a controlled amount of water through the shield to facilitate steering of the boat. In one embodiment, the water control passage means comprises a pair of holes equispaced from the centerline of the shield rear central portion.

The shield is mounted on the transom of the boat such that the center of curvature of the shield is at the center of curvature of the pivot point of the motor so that portions of the shield are always spaced at equal distances from the propeller, regardless of the orientation thereof. This feature facilitates the steering of the boat. Where the boat has an inboard motor, the shield is mounted on the transom of the boat so that the center of curvature of the shield is substantially at the centerline of the boat.

The adjustable support means desirably is a rigid rod pivotably mounted at a lower end to the shield rear portion and releasably mounted at an upper portion to a bracket which in turn is mounted to the transom of the boat. A plurality of holes are provided in the upper portion of the support means so that the position of the shield is vertically adjustable for varying the drag force on the boat.

Preferably, means are provided for supporting the shield in an upright position on the back of the transom for storage of the shield when the brake is not in use. To this end, the adjustable support means is removable from the shield and the shield at the rear portion is mounted to the boat bracket which otherwise is connected to the upper portion of the adjustable support means.

BRIEF DESCRIPTION OF DRAWINGS

The invention will now be described with reference to the accompanying drawings in which.

DESCRIPTION OF THE PREFERRED EMBODIMENT

Figure 1:
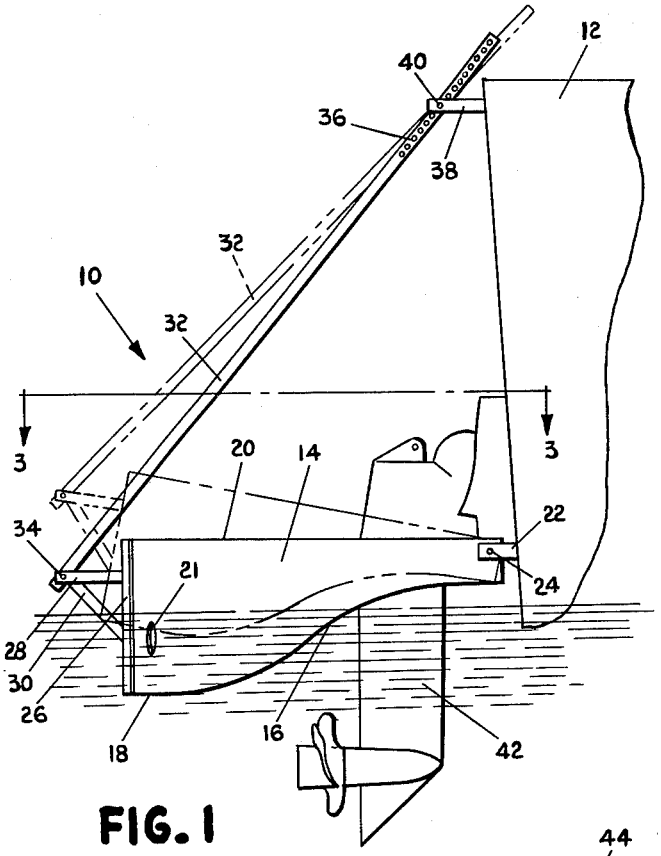
FIG. 1 is a side elevational view of the trolling brake in operative position on the back of a boat.

Referring now to the drawings, there is shown a trolling brake 10 pivotably mounted to the back of a boat 12. The brake comprises a curved shield 14 formed of a sheet of material which is bent into a semicylindrical shape, the shield having side edges 16 which slope from the front edge of the shield downwardly to a back edge 18. A flat top edge 20 extends around the entire shield. Holes 21 are provided in a back portion of shield to assist in steering of the boat.

Figure 3:
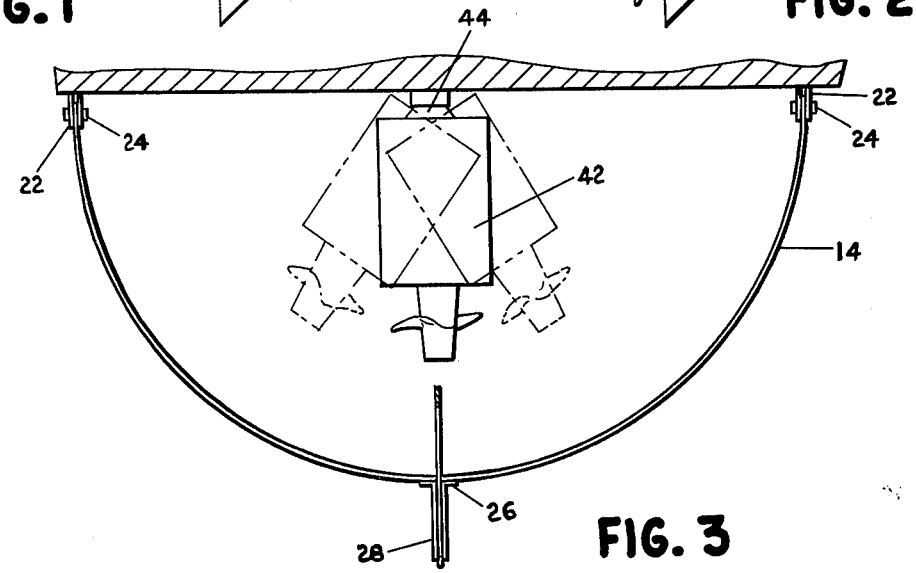
FIG. 3 is a plan view of the trolling brake seen generally along lines 3—3 of FIG. 1.
Figure 4:
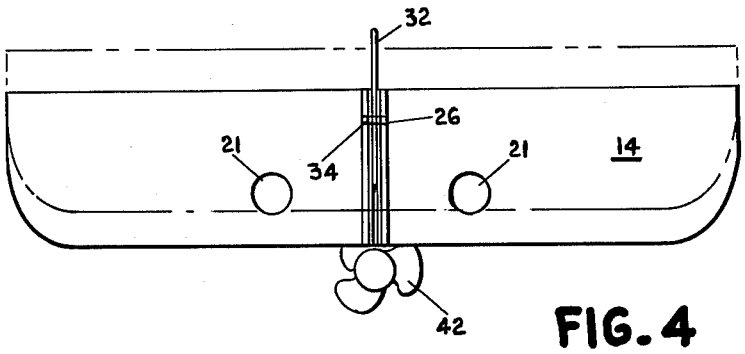
FIG. 4 is a rear elevational view of the trolling brake.

As illustrated in FIG. 3, the shield is substantially semicircular in plan view with the center of curvature being generally at the pivot point 44 for an inboard-outboard drive 42. Thus the shield is always a predetermined distance from the propeller of the motor 42, regardless of the orientation of the motor 42.

The shield is pivotably mounted onto the back of the boat near or at the waterline. To this end, brackets 22 are secured to either side of the back of the boat near the water level and pivotably mount the shield through pins 24.

A vertical bracket 26 is secured to the rear portion of the shield and mounts a rear bracket 28 and a brace 30. An adjusting handle support 32 is pivotably mounted to the rear bracket 28 through a removable pin 34. A plurality of holes are provided in the upper portion of the adjusting handle support 32. A boat bracket 38 is secured to the back of the boat at an upper portion and removable pin 40 extends through the boat bracket and into one of the holes 36 to secure the handle 32 in a desired position.

As illustrated in phantom lines in FIG. 1, the position of the shield with respect to the waterline can be adjusted by adjusting the position of the handle 32 with respect to the bracket 38. The adjustment is easily made by removing pin 40, raising the shield 14 to the desired position and thereafter securing the pin 40 through the bracket 38 and through a suitable hold 36 to maintain the shield 14 in adjusted position.

Figure 2:
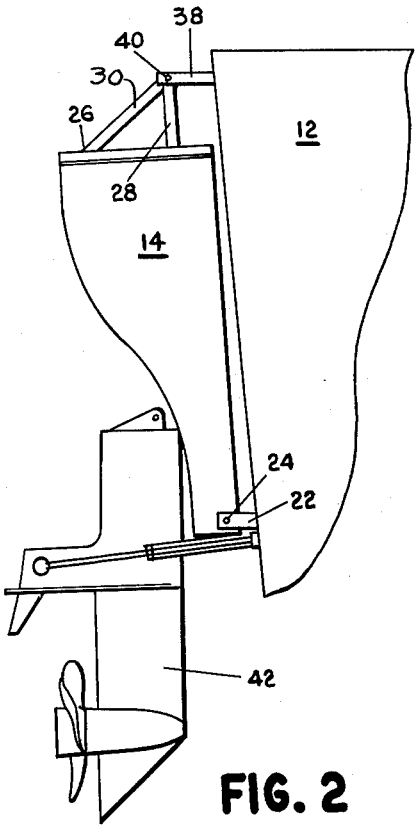
FIG. 2 is a side elevational view of the trolling brake like FIG. 1 with the brake in an inoperative or stored position.

As illustrated in FIG. 2, the shield can be maintained in upright or stored position alongside the back of the boat by raising the shield with the handle 32 until the shield reaches the upright position. The pin 34 is then removed from the bracket 28 and the pin 40 is secured through bracket 38 and through the hole in bracket 28 to maintain the shield in upright position.

Thus, the invention provides an adjustable brake for a boat to allow the boat to troll at very slow speed without stalling the engine. The brake can be easily adjusted during the trolling operation of the boat.

The sides of the shield provide a device which helps keep downrigger wires and fishing lines from becoming entangled with the outdrive unit and propeller. The shape of the shield 14 contains the turbulation from the propeller to avoid drawing downrigger wires into the propeller.

The mounting of the brake on the boat in no way affects the operation or the stresses on the outdrive motor mounting. Further, the invention is adaptable for inboard-outboard motors as illustrated in the drawings as well as inboard motors (not illustrated).

The holes 21 in the back portion of the shield provide a means to control the flow of water through the shield so as to facilitate steering of the boat. The curvature of the shield 14 directs the water around the shield when the motor is turned so that the water passes through the holes in a direction parallel to the position of the motor. This action assists in turning the boat in the desired direction. In one embodiment, two 5 inch diameter holes placed 10 inches on centers from the centerline of the shield have been satisfactorily used.

The mounting of the shield on the boat is significant in order to minimize the adverse effects of the brake on the steering. The center of curvature on the shield is at or near the pivot point for the inboard-outboard motor 42 so that the propeller thereof is always spaced at an equal distance from the shield. In the event that an inboard motor is used, the pivot point of the rudder is at or near the center of curvature of the shield as mounted on the transom of the boat.

The adjusting handle support 32 is of a rigid nature so as to retain the shield in the desired adjusted location. The rigid support 32 prevents the shield from riding up and down with the movement of the boat.

The shape of the shield at the sides prevents undesirable water currents which would tend to tangle downrigger line adjacent to the shield on the back of the boat with the backwash from the motor. Yet the sides are high enough to avoid side drag when the boat is turning. At the same time, the downwardly extending rear portion of the shield effectively produces the desired drag force.

The shield is so designed that it can be made from lightweight materials, e.g. aluminum, fiberglass and the like, although heavier materials can be used if desired.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. A trolling brake for controlling the speed of motor driven watercraft at idle speeds, said brake comprising:

an arcuate shield formed of a lightweight sheet material bent into a partial cylindrical shape from a pair of side portions to a rear central portion, said shield having a top edge and a bottom edge, said bottom edge sloping downwardly and rearwardly from the side portions to the rear central portion to provide a protective shield for downrigger lines and the like at the side portions thereof and to provide a water brake at a back portion thereof;

means for pivotably mounting said shield at the side portions thereof to the transom of a boat;

a rear support member for said shield, said support member being pivotably mounted at a lower end to a rear portion of said shield and having means at an upper end thereof to support said shield in a plurality of adjusted positions; and means for adjustably mounting said upper portion of said support member on the transom of a boat.

2. A trolling brake according to claim 1 and further comprising means at a rear portion of said shield to permit passage of a controlled amount of water through said shield to facilitate steering of the boat.

3. A trolling brake according to claim 2 wherein said rear support member is a rigid member.

4. A trolling brake according to claim 3 wherein said adjustable mounting means has means for releasably mounting said rear support to the transom of a boat.

5. A trolling brake according to claim 3 wherein said adjustable supporting means includes a plurality of spaced holes in an upper portion of said support member.

6. A trolling brake according to claim 1 wherein said shield is semicylindrical in shape.

7. In combination with a boat having a motor and a transom at a rear portion thereof, the improvement in a trolling brake for said boat to enable said boat to move at varying slow speeds while the motor is running at idle speed without stalling of the motor, said trolling brake comprising;

a curved arcuate shield formed of a sheet material bent into a partial cylindrical shape from a pair of side portions to a rear central portion, said shield having a top edge and a bottom edge, said bottom edge sloping downwardly and rearwardly from the side portions to the rear central portion;

means for pivotably mounting said shield at said side portions to the transom of the boat at or near the waterline of the boat during normal operation thereof;

means secured to a rear portion of said shield for adjustably supporting said shield at a rear portion thereof; and means for mounting said adjustable support means to the transom of the boat.

8. The invention of claim 7 wherein said shield has means at the rear central portion to permit the passage of a controlled amount of water through the shield to facilitate steering of the boat.

9. The invention of claim 8 wherein the water control passage means comprises a pair of holes equally spaced from the center line of the shield rear central portion.

10. The invention of claim 7 wherein the motor is an inboard-outboard motor and the center of curvature of the shield is substantially at the pivot point of the motor.

11. The invention of claim 7 wherein the adjustable support means comprises a rigid rod pivotably mounted at a lower end to the shield rear portion, the rod having a plurality of holes at an upper portion thereof; and said adjustable support mounting means comprises a bracket mounted to the transom of the boat and a removable pin engagable with the bracket and with one of the holes of the adjustable support.

12. The invention of claim 7 and further comprising means for releasably mounting the adjustable support means to the rear portion of the shield, the mounting means for the support means including a transom bracket positioned on the upper portion of the boat transom a distance substantially equal to the distance between the releasable mounting means and the pivotable mounting means for the shield; and means for releasably securing the rear shield portion to an upper portion of the transom bracket when the shield is rotated on its pivotable mountings to a substantially vertical position.

13. The invention of claim 12 wherein said shield is semicircular in shape and has means at a rear central portion to permit the passage of a controlled amount of water through the shield to facilitate steering of the boat;

wherein said motor is a inboard-outboard motor and the center of curvature of the shield is substantially at the pivot point of the motor;

said adjustable support means comprises a rigid rod pivotably mounted at a lower end to said shield rear portion and having a plurality of holes at an upper portion of said rod; and said adjustable support mounting means comprises a bracket mounted to the transom of the boat and a pin releasably engagable with said bracket and one of the holes of the adjustable support.

* * * * *